US008876939B2

(12) United States Patent
McLaughlin, III

(10) Patent No.: US 8,876,939 B2
(45) Date of Patent: Nov. 4, 2014

(54) PROCESS AND SYSTEM FOR BRIQUETTING TITANIUM

(75) Inventor: Henry W. McLaughlin, III, Vandergrift, PA (US)

(73) Assignee: Titanium Metal Conversions, Vandergrift, PA (US)

( * ) Notice: Subject to any disclaimer, the term of this patent is extended or adjusted under 35 U.S.C. 154(b) by 199 days.

(21) Appl. No.: 13/557,057

(22) Filed: Jul. 24, 2012

(65) Prior Publication Data

US 2013/0029160 A1 Jan. 31, 2013

Related U.S. Application Data

(60) Provisional application No. 61/511,381, filed on Jul. 25, 2011.

(51) Int. Cl.

| | |
|---|---|
| ***C22B 1/00*** | (2006.01) |
| ***B30B 9/32*** | (2006.01) |
| ***B30B 11/26*** | (2006.01) |
| ***C22B 1/248*** | (2006.01) |

(52) U.S. Cl.

CPC ..... *B30B 9/327* (2013.01); *B30B 11/26* (2013.01); *C22B 1/248* (2013.01); *Y10S 75/962* (2013.01)

USPC ..... 75/770; 75/962; 23/313 R

(58) Field of Classification Search

CPC ..... C22B 1/248; B32B 15/04
USPC ..... 75/770, 962; 23/313 R
See application file for complete search history.

(56) References Cited

U.S. PATENT DOCUMENTS

| | | | | |
|---|---|---|---|---|
| 3,414,408 | A * | 12/1968 | Eichenberger | 419/23 |
| 5,597,401 | A * | 1/1997 | Megy | 75/304 |
| 8,221,893 | B2 * | 7/2012 | Slimak et al. | 428/532 |
| 2011/0119948 | A1 * | 5/2011 | Niemann et al. | 34/209 |

FOREIGN PATENT DOCUMENTS

RU 282598 A * 10/2008

* cited by examiner

*Primary Examiner* — George Wyszomierski
*Assistant Examiner* — Tima M McGuthry Banks
(74) *Attorney, Agent, or Firm* — McGuireWoods LLP

(57) ABSTRACT

A system and a method are provided that take a potentially dangerous waste product and process the product to create a marketable asset. The system and method are configured to create "tb" from "tbgs" by removing the volatility that exists in the "tbgs." The resultant "tb" may be substantially non-volatile.

8 Claims, 11 Drawing Sheets

SECTION A-A
(3"=1")

FIG. 6

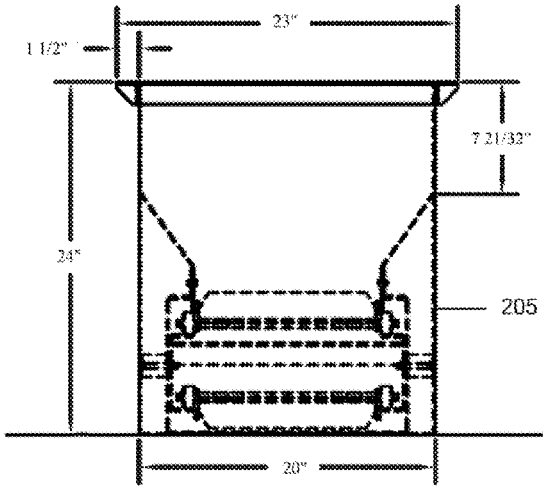

SPEED: 3-30 F.P.M.
MOTOR: 3/4 HP 230/460/3/60 T.E.N.V. INVERTER DUTY
REDUCER: GROVE GRG BMQ818 30:1 56C (ASSEMBLY "L")
SPROCKETS: 40B14 x 7/8" (REDUCER)
40A36 x 3" (TORQUE LIMITER)
TORQUE LIMITER: 500TL X 1 3/16" (1) SPRING (DRIVE SHAFT)
#40 DRIVE CHAIN: 77 TOTAL PITCHES (75 P-37 1/2" LG. + ONE OFFSET LINK & ONE CONNECTING LINK)
BELT SPROCKETS: 5" P.D. x 6 TOOTH W/ 1 3/16" DIA. BORE - BUSHED – 2 REQ'D - INFEED
5" P.D. x 6 TOOTH W/ 1 3/16" DIA. BORE - KEYWAY & S.S. 2 REQ'D - DISCHARGE
BELT: 12" WIDE – 2 1/2" PITCH 12 GA. PERFORATED APRONS – 1 1/2" HIGH X 10 GA SIDEWINGS
2" HIGH CLEATS ON 12 1/2" CENTERS – 1 1/2" DIA. P/M ROLLERS
BELT LENGTH: 119P. (24'-9 1/2")'
PAINT: STANDARD TITAN GRAY
CONTROLS: NONE

FIG. 7

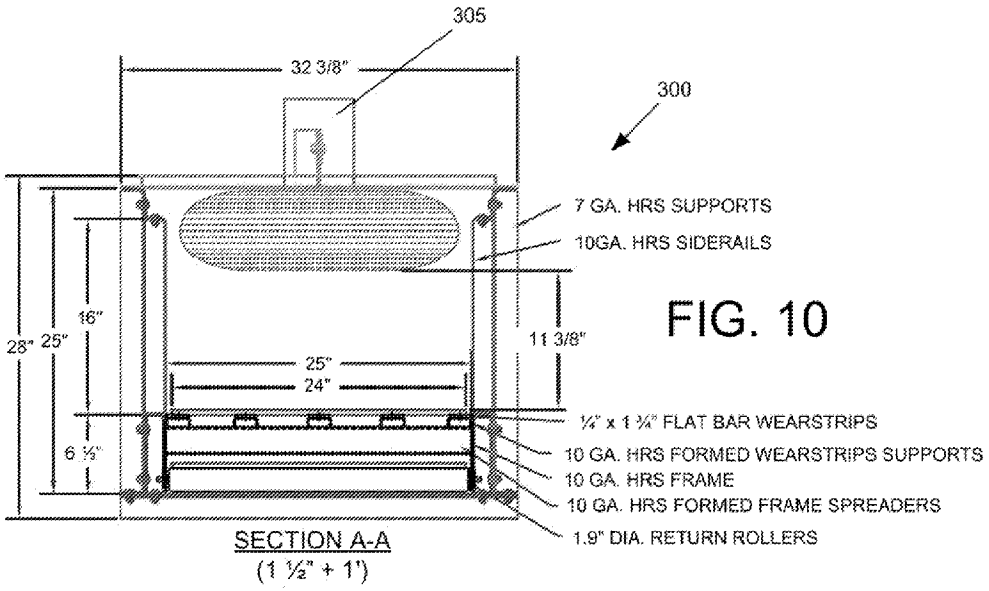

FIG. 10

SPEED: 3-30 F.P.M.
MOTOR: 1 HP 230/460/3/60 1800 RPM INVERSION DUTY 145TC
REDUCER: GROVE GRG BMQ824 40:1 145TC
SPROCKETS: 50B13 x 1 1/8" BORE (REDUCER)
50B22 x 1 7/16" BORE (DRIVE SHAFT)
#50 DRIVE CHAIN: 61 P. TOTAL (59 PITCHED + ONE CONNECTING LINK & ONE OFFSET LINK)
BELT SPROCKETS: 4.44" P.D. x 13 TOOTH W/ 1 3/16" BORE (BUSHED) (2-INFEED)
4.44" P.D. x 13 TOOTH W/ 1 3/16" BORE (KEYED & S.S.) (1-INFEED)
4.44" P.D. x 13 TOOTH W/ 1 7/16" BORE (KEYED & S.S.) (4-DRIVE)
BELT LENGTH: 81"
PAINT: STANDARD TITAN GRAY
CONTROLS: NEMA 1 ENCLOSURE. A.C. VARIABLE SPEED INVERTER, NON REVERSING. WITH OVERLOAD PROTECTION, 110 VOLT TRANSFORMER, BUILT IN START/STOP PUSH BUTTONS, 460 VOLTS 3 PHASE INCOMING POWER

FIG. 11

SECTION B-B
(1 ½"=1')

PROCESS AND SYSTEM FOR BRIQUETTING TITANIUM

This application claims benefit and priority to U.S. Provisional Application No. 61/511,381, filed Jul. 25, 2011, and entitled "A PROCESS FOR BRIQUETTING TITANIUM," the disclosure of which is incorporated by reference herein in its entirety.

FIELD OF THE DISCLOSURE

The present disclosure relates to a system and a method for creating "titanium briquettes" (tb) from "titanium belt grinding swarf" (tbgs), or the like.

BACKGROUND OF THE DISCLOSURE

Generally, "tbgs" is a highly volatile and flammable waste by-product that results from "tbgs" processes. Given its characteristics, significant challenges exist in handling and storing "tbgs". An unfulfilled need exists for a system or a process that may remove the volatility that exists with the "tbgs".

The disclosure provides a system and a method for making "tb" from "tbgs," including the removal of volatility from "tbgs".

SUMMARY OF THE DISCLOSURE

According to an aspect of the disclosure, a system is provided that takes a potentially dangerous waste product and processes the product to create a marketable asset. The system is configured to create "tb" from "tbgs" by removing the volatility that exists in the "tbgs." The resultant "tb" may be substantially non-volatile.

The system may comprise, for example, one or more Applied Recovery Systems (ARS) 600 briquetting machines comprising a feed hopper with an agitator and ram assist, a compression chamber, a hydraulic ram, a tank, a conveyor, a chain mesh belt drying conveyor, a plurality of high performance fans. The chain mesh belt drying conveyor may be contained in a substantially air-tight container (i.e., a substantially sealed container) that may include one or more TD-2000 descant wheel dehumidifiers, which may be attached to the container. The chain mesh belt drying conveyor may be, for example, about 24" wide and about 40 feet long. Other dimensions are contemplated for the chain mesh belt drying conveyor.

The plurality of high performance fans may be located above the mesh conveyor. The one or more TD-2000 descant wheel dehumidifiers may constantly turn the gas (e.g., air) within the container until the gas has minimal moisture content, such as, for example, about 0% moisture content. The gas (e.g., air) may be directed to and blown on the "tb" by the plurality of fans, thereby causing the "tb" to become about 100% dry. The plurality of fans may be configured to circulate the gas (air) around the entire "tb," for example, 360 degrees around the "tb."

The system may be further configured to add a sodium silicate solution to further dry the "tb" by withdrawing whatever residual water moisture may exist in the "tb." The "tb" may be completely immersed in a fire retardant such as, for example, the sodium silicate solution so as to fire proof the "tb".

According to a further aspect of the disclosure, a process is disclosed for removing volatility from waste by-products such as, for example, "tbgs". The process comprises: dumping, for example, 55 gallon drums of "tbgs" mixed with a liquid such as, for example, water, into a top feed hopper in one or more "ARS" 600 briquetting machines (or the like); churning the material by a paddle in the bottom of the hopper; providing the churned material to a compression chamber located at the bottom of the hopper; and compressing the churned material by means of, for example, a hydraulic ram to compress the scarf and water into one or more "tb" having predetermined dimensions, such as, for example, 2¾"×2¾". The process of compressing the churned material "tbgs" may remove substantially all but, for example, about 4-5% of the water from the "tbgs."

The process may further comprise dropping (or providing) the puck into a tank that may be filled with a solution that includes, for example, sodium silicate. The tank may comprise a conveyor in the bottom of the tank. The process may comprise keeping the pucks in the solution for approximately 3 minutes or long enough for the surface of the pucks to be thoroughly coated.

The process may comprise conveying the "tb" up and out of the tank at a rate that allows excess solution to drip off the coated "tb" and run back into the tank. When the coated "tb" reach the end of the conveyor, the process may comprise dropping (or providing) the coated "tb" onto a chain mesh belt drying conveyor. This conveyor may be, for example, about 24" wide and about 40 feet long.

The process may comprise operating, for example, 20 high performance fans that are located above the mesh conveyor to the dry the coated "tb." This conveyor may be contained in an air tight container that includes one or more TD-2000 descant wheel dehumidifiers attached to the container. The process may comprise constantly turning the gas (e.g., air) within the container to dry the gas (air) to substantially 0 degree humidity. Thus, the gas (e.g., air) that the 20 fans blow on the drying conveyor dries the "tb" to about 100% dry, circulating the gas in the container by 360 degrees around the "tb."

The process may comprise driving the drying conveyor such that it takes, for example, one or more hour for the coated "tb" to travel the 40 feet in a hurricane type dry wind. The addition of sodium silicate salt to the process may draw whatever residual water moisture remains within the "tb," so as to accelerate the drying process. The resultant dried "tb" may be approximately 100% moisture free and with a sodium silicate coating that resists ignition by flames.

The process may further comprise dropping (or providing) the resultant dried "tb" into one or more DOT approved, three ring 55 gallon drums or wire baskets. When the drums or baskets become full, the process may comprise placing the "tb" into a plurality of containers with, e.g., one or more TD 2000 dehumidifiers to ensure that the "tb" are approximately 100% dry. In this regard, the lids may be kept off the drums and plurality of fans (e.g., 20 fans) in the container may be operated for, for example, 1 to 100 hours.

In one aspect, a system for processing swarf may be provided. The system may include a briquetting machine configured to receive titanium swarf and to produce a plurality of titanium briquettes from the titanium swarf and a coating apparatus configured to coat the titanium briquettes with a fire retardant.

In one aspect, a method for processing titanium swarf may be provided, the method may include converting titanium swarf into titanium briquettes and applying a fire retardant to the titanium briquettes. The applying step may include coating or immersing the titanium briquettes with a fire retardant or a fire proofing material.

Additional features, advantages, and embodiments of the disclosure may be set forth or apparent from consideration of the detailed description and drawings. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings:

FIG. 6 shows a width view of a portion of the conveyor of FIG. 4, looking in from the left side of FIG. 4;

FIG. 7 shows an example of values that may be used for various components of the conveyor of FIG. 4, including operational values, component dimension values, and the like;

FIG. 10 shows a section A-A of the drying conveyor in FIG. 9;

FIG. 11 shows an example of values that may be used for various components of the drying conveyor of FIG. 9, including operational values, component dimension values, and the like.

Figure 1:
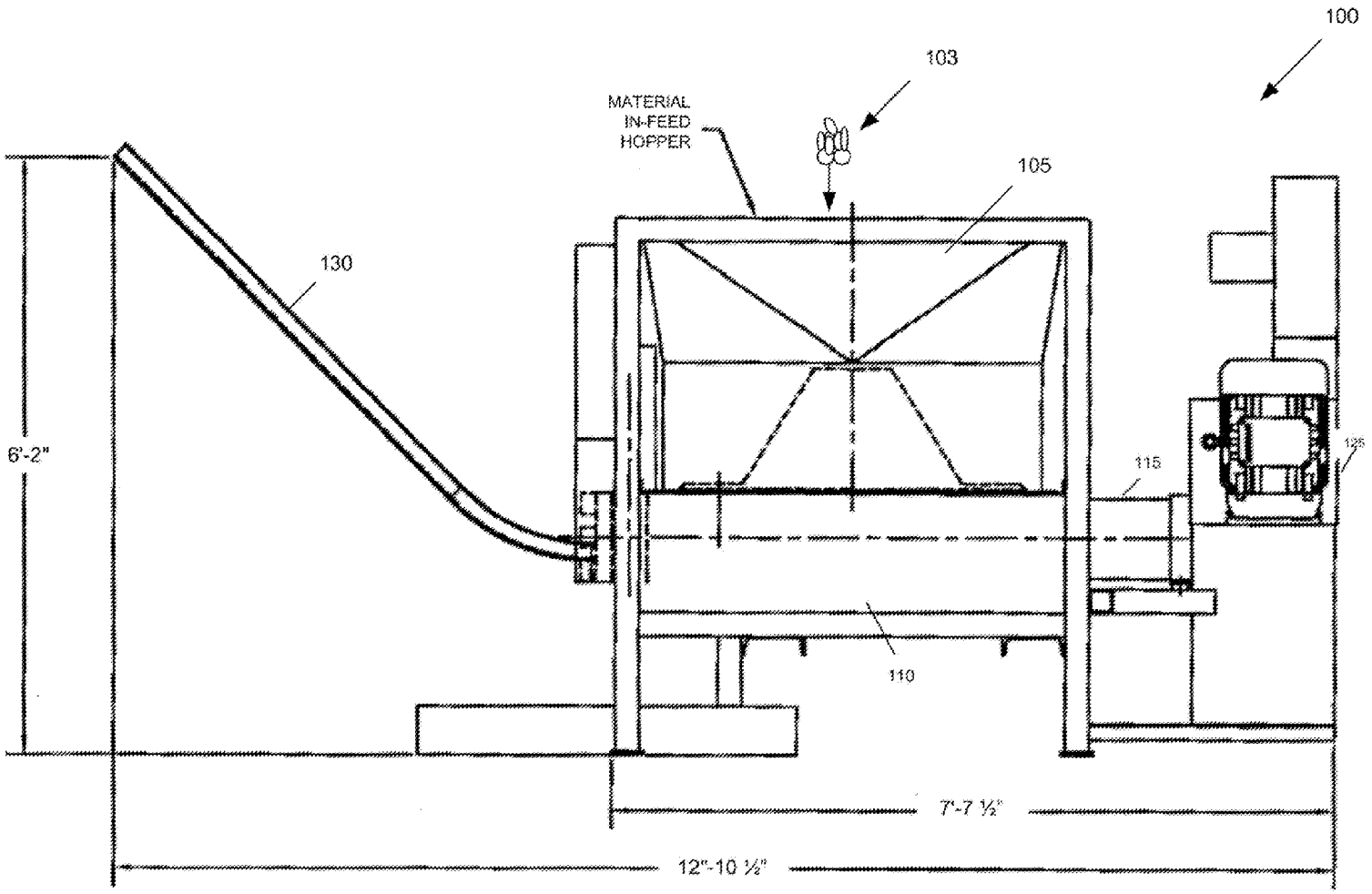
FIG. 1 shows a first view of an example of an ARS-600 briquetting machine, which may include a hopper, a compression chamber, and a hydraulic ram.

The present disclosure is further described in the detailed description that follows.

DETAILED DESCRIPTION OF THE DISCLOSURE

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

A "computer", as used in this disclosure, means any machine, device, circuit, component, or module, or any system of machines, devices, circuits, components, modules, or the like, which are capable of manipulating data according to one or more instructions, such as, for example, without limitation, a processor, a microprocessor, a central processing unit, a general purpose computer, a super computer, a personal computer, a laptop computer, a palmtop computer, a notebook computer, a desktop computer, a workstation computer, a server, or the like, or an array of processors, microprocessors, central processing units, general purpose computers, super computers, personal computers, laptop computers, palmtop computers, notebook computers, desktop computers, workstation computers, servers, or the like.

A "server", as used in this disclosure, means any combination of software and/or hardware, including at least one application and/or at least one computer to perform services for connected clients as part of a client-server architecture. The at least one server application may include, but is not limited to, for example, an application program that can accept connections to service requests from clients by sending back responses to the clients. The server may be configured to run the at least one application, often under heavy workloads, unattended, for extended periods of time with minimal human direction. The server may include a plurality of computers configured, with the at least one application being divided among the computers depending upon the workload. For example, under light loading, the at least one application can run on a single computer. However, under heavy loading, multiple computers may be required to run the at least one application. The server, or any if its computers, may also be used as a workstation.

A "database", as used in this disclosure, means any combination of software and/or hardware, including at least one application and/or at least one computer. The database may include a structured collection of records or data organized according to a database model, such as, for example, but not limited to at least one of a relational model, a hierarchical model, a network model or the like. The database may include a database management system application (DBMS) as is known in the art. The at least one application may include, but is not limited to, for example, an application program that can accept connections to service requests from clients by sending back responses to the clients. The database may be configured to run the at least one application, often under heavy workloads, unattended, for extended periods of time with minimal human direction.

A "communication link", as used in this disclosure, means a wired and/or wireless medium that conveys data or information between at least two points. The wired or wireless medium may include, for example, a metallic conductor link, a radio frequency (RF) communication link, an Infrared (IR) communication link, an optical communication link, or the like, without limitation. The RF communication link may include, for example, WiFi, WiMAX, IEEE 802.11, DECT, 0G, 1G, 2G, 3G or 4G cellular standards, Bluetooth, and the like.

The terms "including", "comprising" and variations thereof, as used in this disclosure, mean "including, but not limited to", unless expressly specified otherwise.

The terms "a", "an", and "the", as used in this disclosure, means "one or more", unless expressly specified otherwise.

Devices that are in communication with each other need not be in continuous communication with each other, unless expressly specified otherwise. In addition, devices that are in communication with each other may communicate directly or indirectly through one or more intermediaries.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices which are not explicitly described as having such functionality or features.

A "computer-readable medium", as used in this disclosure, means any medium that participates in providing data (for example, instructions) which may be read by a computer. Such a medium may take many forms, including non-volatile media, volatile media, and transmission media. Non-volatile media may include, for example, optical or magnetic disks and other persistent memory. Volatile media may include dynamic random access memory (DRAM). Transmission media may include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a computer. For example, sequences of instruction (i) may be delivered from a RAM to a processor, (ii) may be carried over a wireless transmission medium, and/or (iii) may be formatted according to numerous formats, standards or protocols, including, for example, WiFi, WiMAX, IEEE 802.11, DECT, 0G, 1G, 2G, 3G or 4G cellular standards, Bluetooth, or the like.

Figure 2:
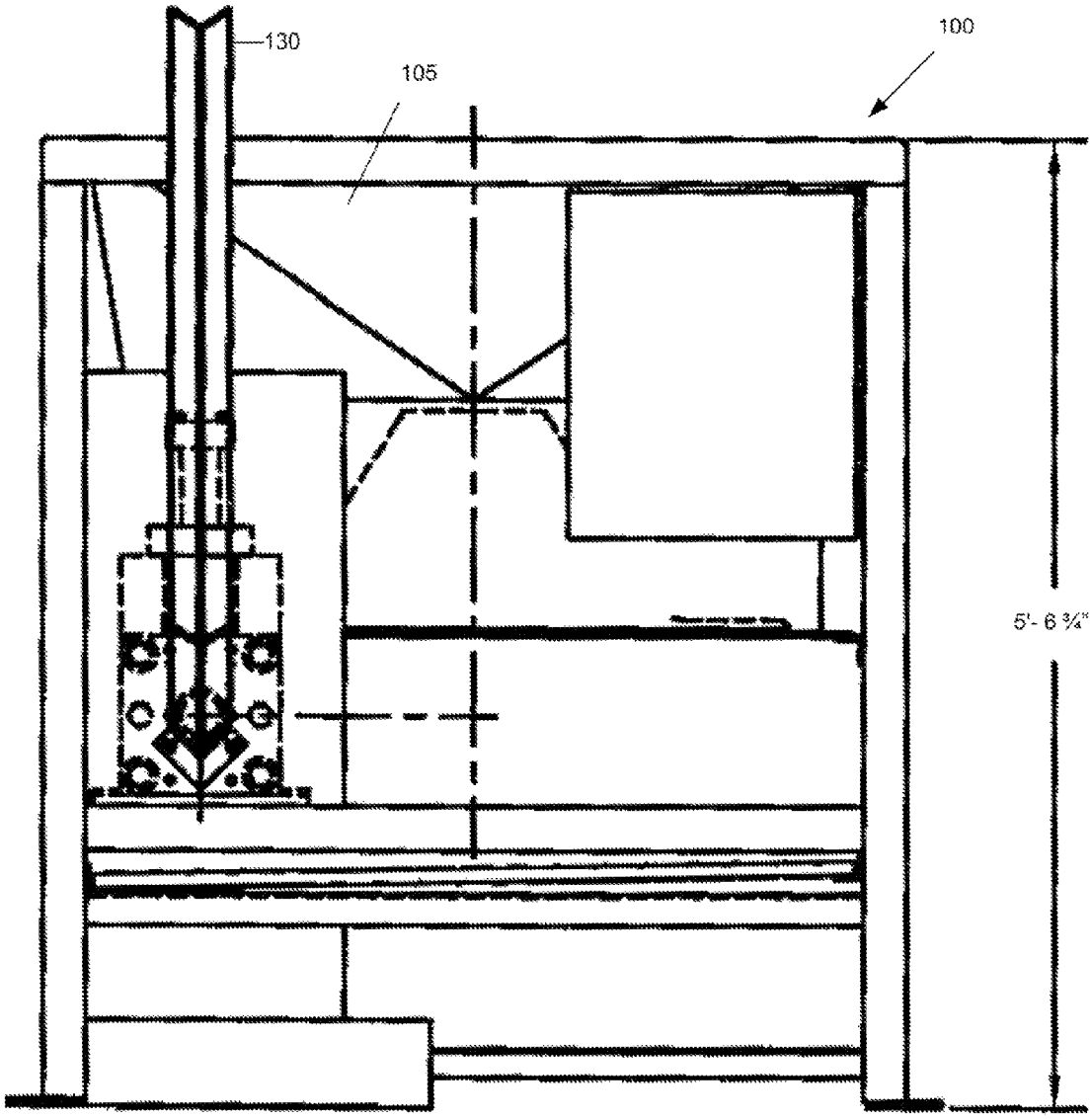
FIG. 2 shows a second view of the ARS-600 briquetting machine.
Figure 3:
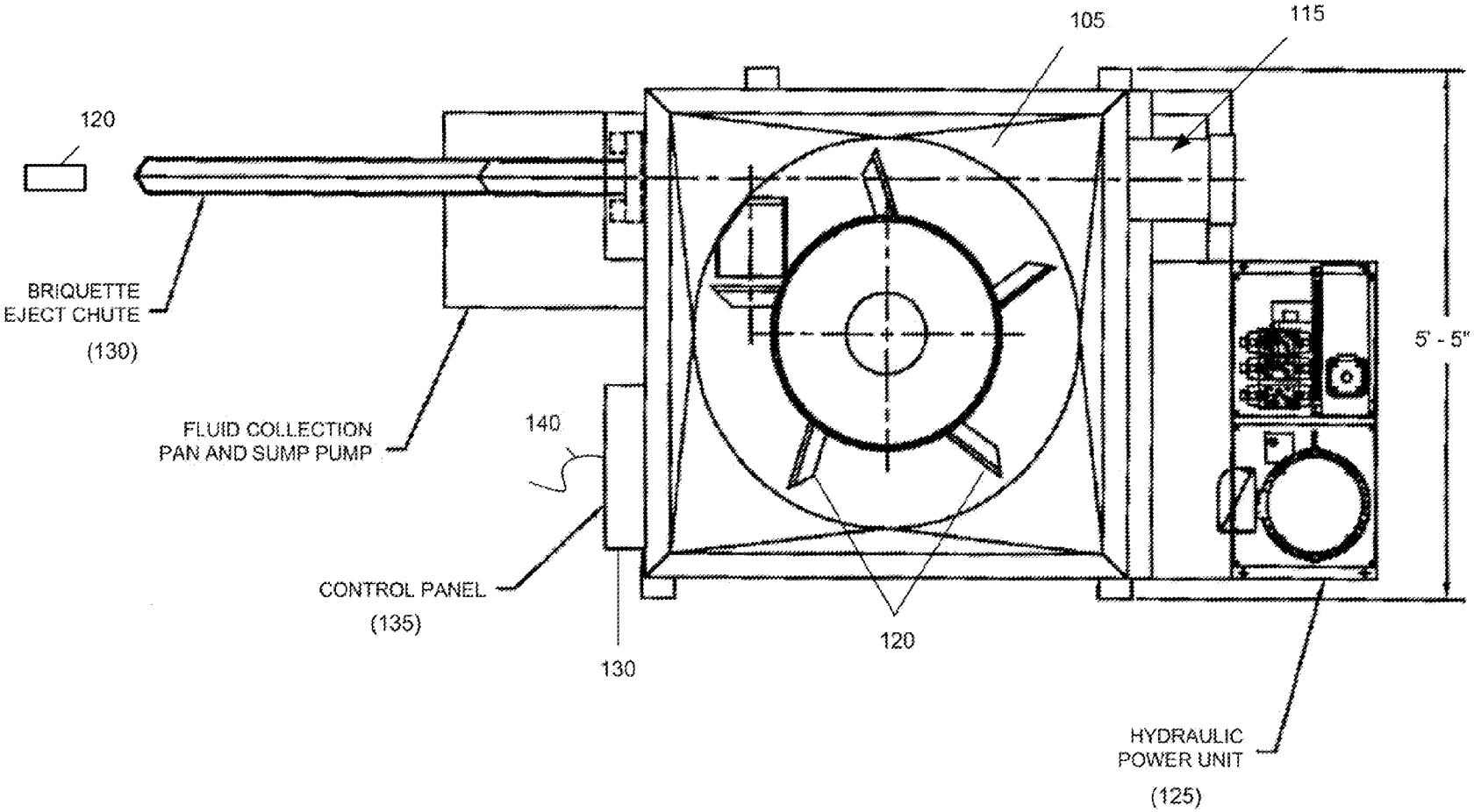
FIG. 3 shows a top view of the ARS-600 briquetting machine.
Figure 4:
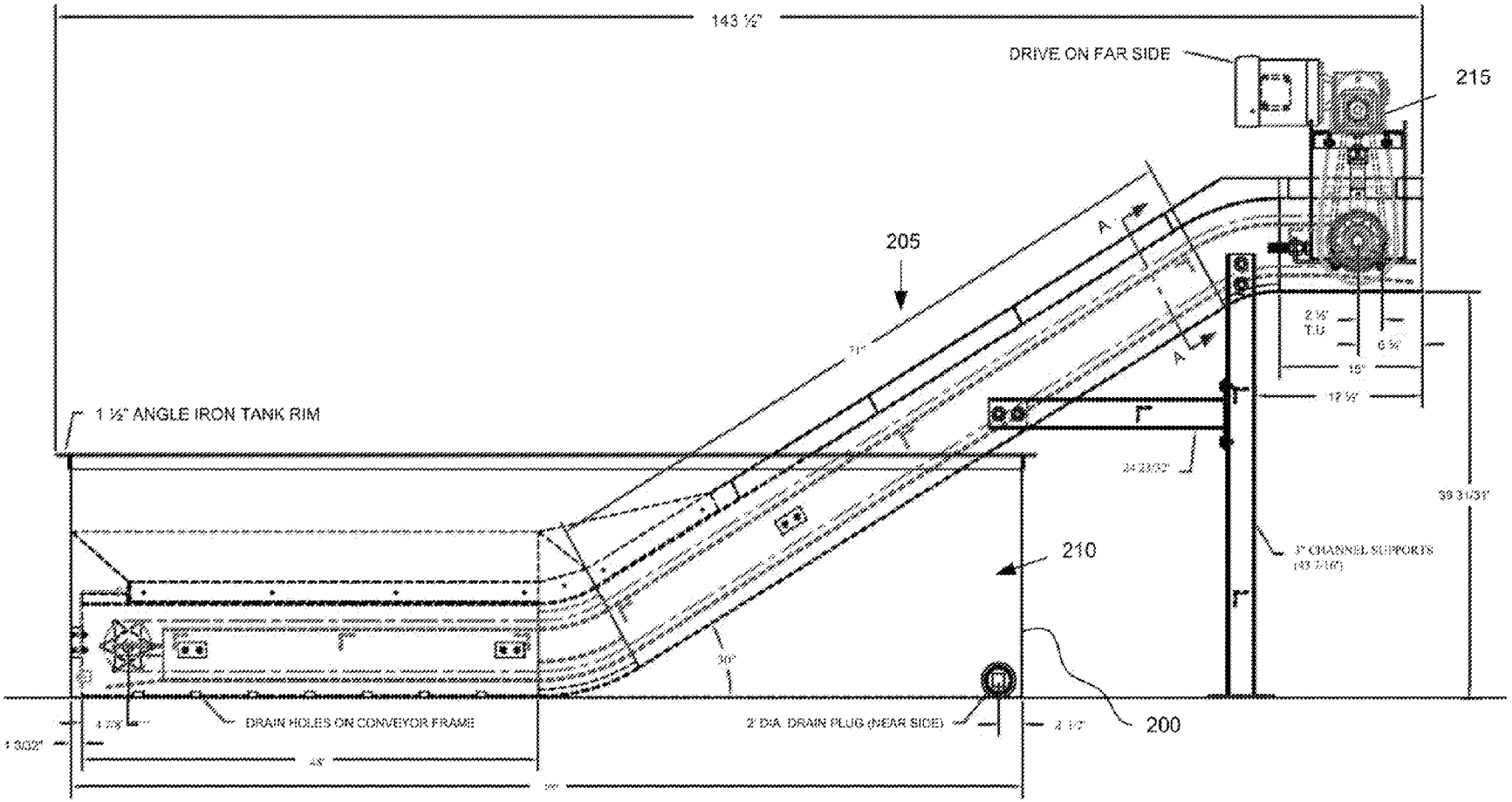
FIG. 4 shows a longitudinal view of an example of a tank, including a conveyor.
Figure 5:
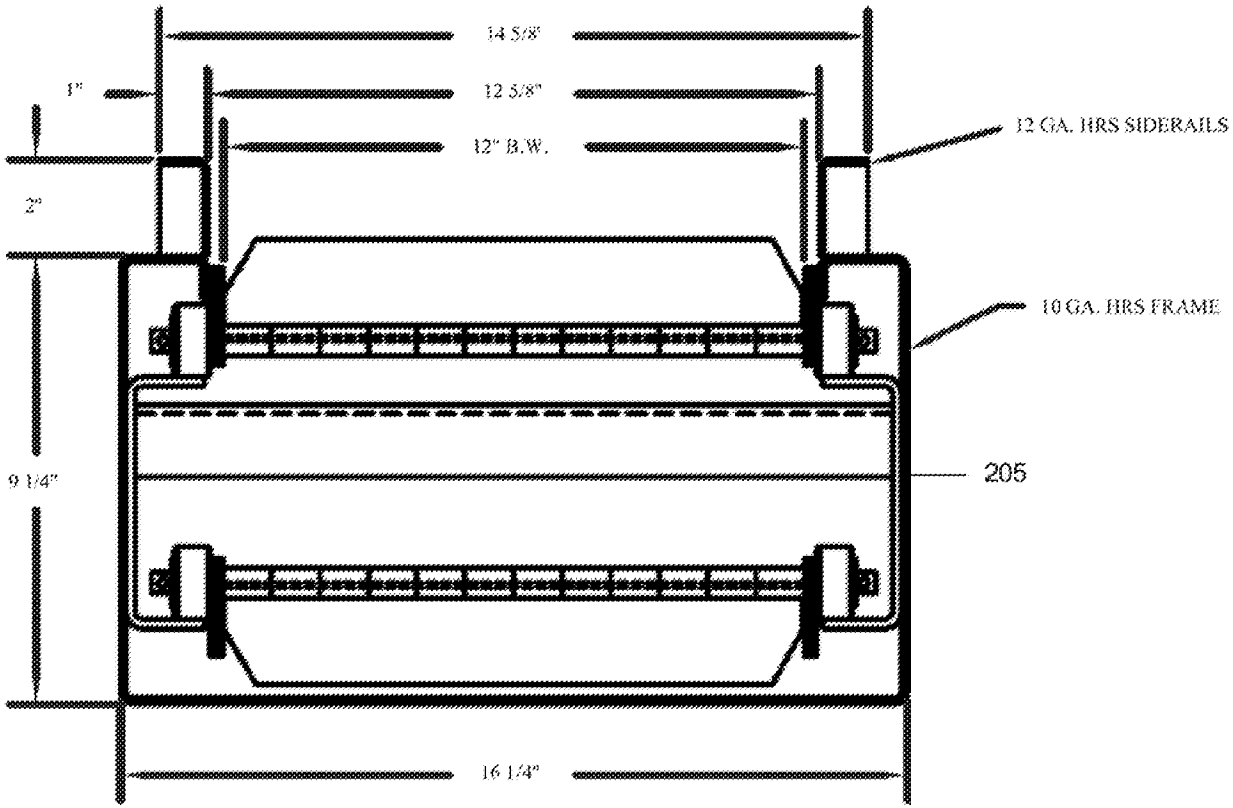
FIG. 5 shows a section A-A of the conveyor in FIG. 4.
Figure 8:
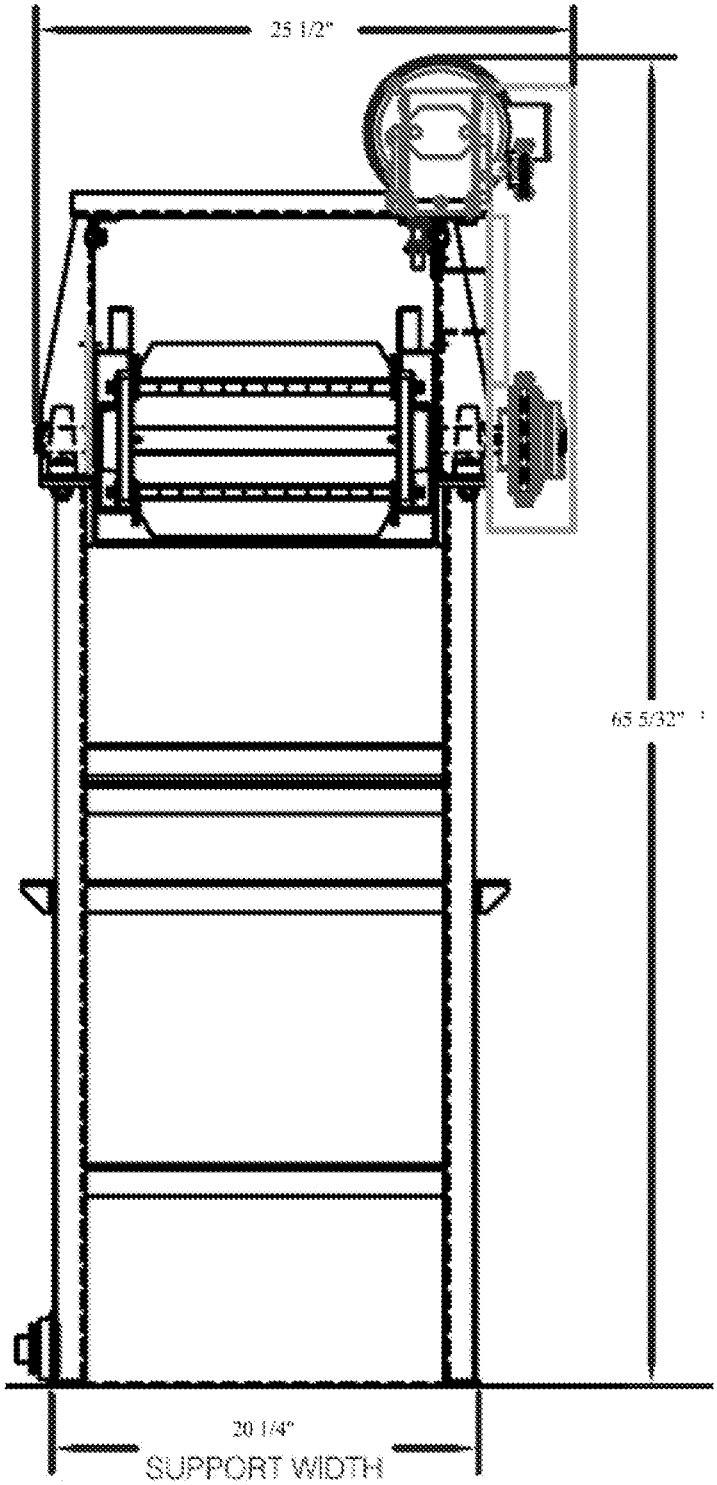
FIG. 8 shows a width view of another portion of the conveyor of FIG. 4, looking in from the ride side of FIG. 4.
Figure 9:
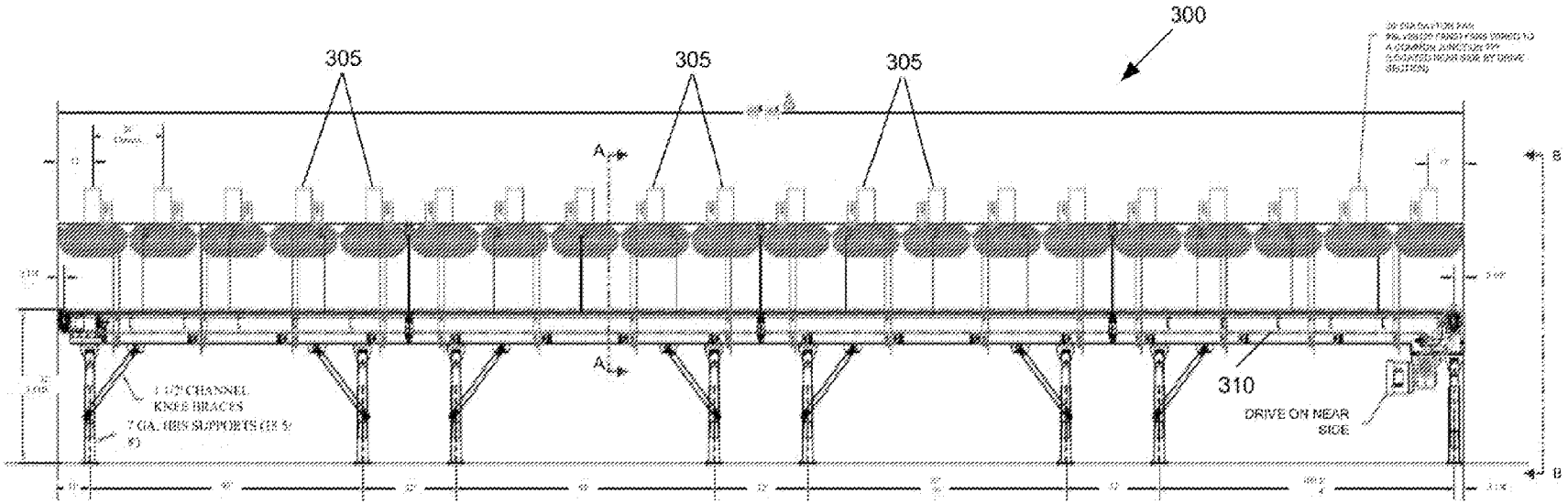
FIG. 9 shows a longitudinal view of an example of a drying conveyor, including a plurality of fans.
Figure 12:
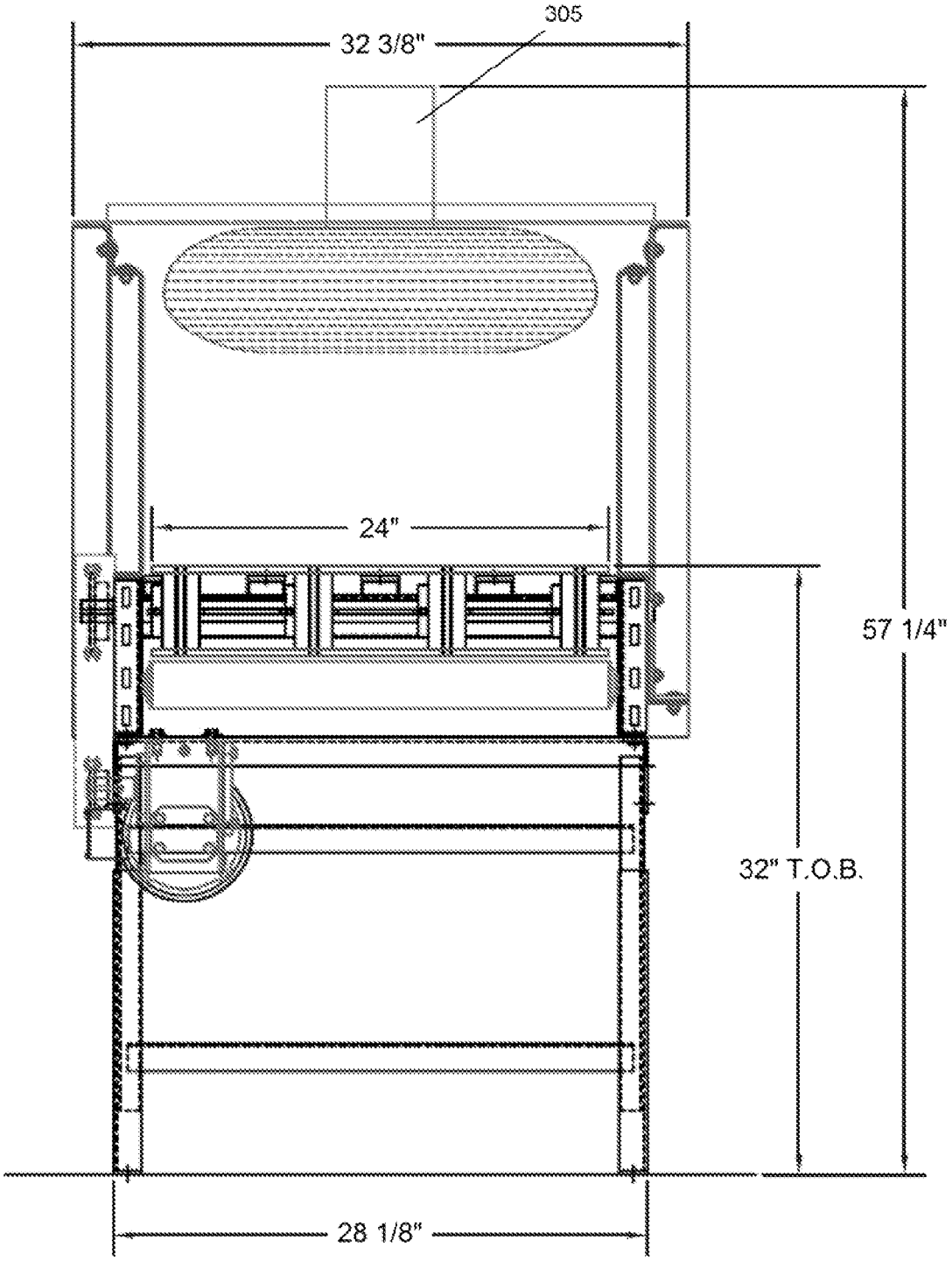
FIG. 12 shows a section B-B of the drying conveyor in FIG. 9.

FIGS. 1-12 show various aspects of the disclosure. In particular, FIG. 1 shows a first view of an example of an ARS-600 briquetting machine 100, which may include a hopper 105, a compression chamber 110, and a hydraulic ram 115; FIG. 2 shows a second view of the ARS-600 briquetting machine 100; FIG. 3 shows a top view of the ARS-600 briquetting machine 100; FIG. 4 shows a longitudinal view of an example of a briquette coating apparatus that may comprise tank 200 and a conveyance mechanism such as conveyor 205; FIG. 5 shows a section A-A of the conveyor 205 in FIG. 4 with exemplary dimensions; FIG. 6 shows a width view of a portion of the conveyor 205 of FIG. 4, looking in from the left side of FIG. 4; FIG. 7 shows an example of values that may be used for various components of the conveyor 205 of FIG. 4, including operational values, component dimension values, and the like; FIG. 8 shows a width view of another portion of the conveyor 205 of FIG. 4, looking in from the right side of FIG. 4; FIG. 9 shows a longitudinal view of an example of a drying conveyor 300, including a plurality of fans 305; FIG. 10 shows a section A-A of the drying conveyor in FIG. 9; FIG. 11 shows an example of values that may be used for various components of the drying conveyor of FIG. 9, including operational values, component dimension values, and the like; and FIG. 12 shows a section B-B of the drying conveyor 300 in FIG. 9.

Referring to FIGS. 1-6, 8-10 and 12, a system is disclosed that takes a potentially dangerous waste product and processes the product to create a marketable asset. The system is configured to create pucks from scarf by removing, or at least significantly reducing, the volatility that may exist in the scarf. The resultant "tb" 120 may be substantially non-volatile.

As seen in FIGS. 1-6, 8-10 and 12 the system may comprise, for example, one or more ARS-600 briquetting machines 100, a hopper 105, a compression chamber 110, a hydraulic ram 115, a briquette eject chute 130 to convey the briquette 120 from the compression chamber 110, a tank 200, a conveyor 205, a chain mesh belt drying conveyor 310, a plurality of high performance fans. The briquetting machines 100 may also include a liquid input source, such as an input for water, for creating a mixture.

Figure 13:
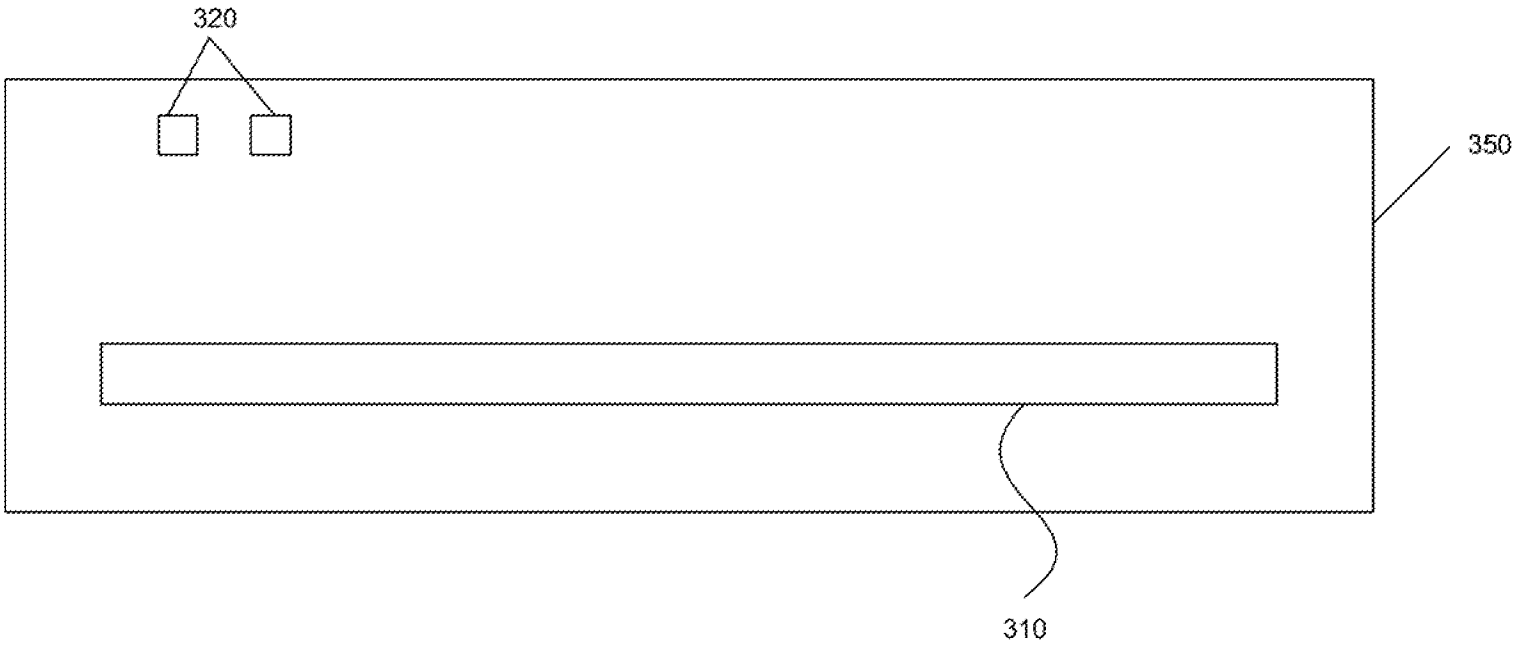
FIG. 13 shows a container and conveyor for drying briquettes, configured according to principles of the disclosure.

The chain mesh belt drying conveyor 310, shown in, for example, FIG. 9, may be contained in a substantially air-tight container 350 (FIG. 13), that may include one or more TD-2000 descant wheel dehumidifiers 320, which may be attached to the container 350. The chain mesh belt drying conveyor 310 may be, for example, about 24" wide and about 40 feet long. Other dimensions are contemplated for the chain mesh belt drying conveyor 310.

The plurality of high performance fans 305 may be located above the mesh conveyor 310. The one or more TD-2000 descant wheel dehumidifiers 320 may constantly turn the gas (e.g., air) within the container until the gas has minimal moisture content, such as, for example, about 0% moisture content. The gas (e.g., air) may be directed to and blown on the "tb" by the plurality of fans, thereby causing the "tb" 120 to be about 100% dry. The plurality of fans may be configured to circulate the gas (air) around the entire "tb" 120, for example, 360 degrees around the "tb" 120.

The system may be further configured to add sodium silicate solution to further dry the "tb" 120 by withdrawing whatever residual water moisture may exist in the "tb" 120. The "tb" 120 may be completely immersed in the sodium silicate solution so as to fire proof the "tb" 120.

According to a further aspect of the disclosure, a process is disclosed for removing volatility from waste by-products such as, for example, "tbgs". The process comprises: dumping, for example, 55 gallon drums of "tbgs" mixed with water into a top feed hopper 105 in one or more ARS-600 briquetting machines 100 (or the like), shown in FIGS. 1-3; churning the material by a paddle 120 in the bottom of the hopper 105; providing the churned material to a compression chamber located at the bottom of the hopper, shown in FIGS. 1-3; and compressing the churned material by means of, for example, a hydraulic ram 115 which may be powered by a hydraulic power unit 125 to compress the "tbgs" and water into one or more "tb" 120 having predetermined dimensions, such as, for example, 2¾"×2¾", shown in FIG. 3. The process of compressing the churned material "tbgs" may remove substantially all but, for example, about 4-5% of the water from the "tbgs."

The process may further comprise dropping (or providing) the "tb" 120 into a tank 200 that may be filled with a solution that includes a fire retardant or fire proofing material, for example, sodium silicate, shown in FIGS. 4-8. The tank 200 may comprise a conveyor 205 at least partially in the bottom of the tank. The process may comprise keeping or immersing the pucks in the solution for approximately 3 minutes or long enough for at least the surface of the "tb" 120 to be thoroughly coated. The conveyor 205 may be propelled by an appropriate motor 215. Other fire retardants or fire-proofing material are contemplated.

The process may comprise conveying the "tb" 120 up and out of the tank 200 at a rate that allows excess solution to drip off the coated "tb" 120 and run back into the tank 200, shown in FIGS. 4-8. When the coated "tb" reach the end of the conveyor 205, the process may comprise dropping (or providing) the coated "tb" onto a chain mesh belt drying conveyor 310, shown in FIGS. 9-12. This conveyor may be, for example, about 24" wide and about 40 feet long. The conveyor 205 may be in proximity to the chain mesh drying conveyor 310 so that continuous processing might occur.

The process may comprise operating, for example, 20 high performance fans 205 that are located above the mesh conveyor 310 to the dry the coated "tb" 120, shown in FIG. 9. The fans 205 may be variable speed. This conveyor 310 may be contained in an air tight container 350 that may include two or more TD-2000 descant wheel dehumidifiers 320 attached to the container 350. The process may comprise constantly turning the gas (e.g., air) within the container 350 to dry the gas (air) to substantially 0 percent humidity. Thus, the gas (e.g., air) that the 305 fans blow on the drying conveyor 310 dries the "tb" 120 to about 100% dry, circulating the gas in the container by 360 degrees around the "tb" 120. The container 350 may be configured with doors (not shown) to permit entry and exit of the briquettes 120, and may permit substantial sealing of the container 350. The doors may be automatically controlled by a computer 130.

The process may comprise driving the drying conveyor 310 such that it takes, for example, about an hour or more for the coated pucks 120 to travel the 40 feet in a "hurricane type" dry wind. The addition of sodium silicate salt to the process may draw whatever residual water moisture remains within the "tb," so as to accelerate the drying process. The resultant dried "tb" may be approximately 100% moisture free and with a sodium silicate coating that resists ignition by flames.

The process may further comprise dropping (or providing) the resultant dried "tb" 120 into one or more DOT approved, three ring 55 gallon drums (not shown). When the drums become full, the process may comprise placing the "tb" into a plurality of containers and or wire baskets with, e.g., one or more TD 2000 dehumidifiers to ensure that the "tb" are approximately 100% dry. In this regard, the lids may be kept off the drums or wire baskets and plurality of fans (e.g., 20 fans) in the container may be operated for, for example, about 1 to 100 hours.

Alternatively, the process may include a drying stage for drying the "tb" that may include freezing the "tb" to a temperature of about 0° to about 25° F. Raising the temperature rapidly (i.e., heating) to about 100° F. in mechanically dehumidified conditions. Repeating the freezing and heating steps (i.e., raising the temperature step) until the "tb" has lost between 12 and 15% of its own original weight. This process produced moisture free conditions of less than 0.05 moisture content.

The system shown in FIGS. 1-6, 8-10, and 12 may include a computer 130 to control one or more of operations of the system and may include a control panel 135. The computer may be remotely operated via one or more communication links 140. The computer 130 may be operatively coupled to a database (not shown), which may include operational parameters, such as, for example, the values shown in FIGS. 7 and 11. The computer 130 may be configured to receive a computer readable medium that comprises computer executable code, which when executed by the computer may cause the processes described herein to be carried out. The computer 130 may comprise multiple computers. The at least one computer 130 may control the operations of the briquetting machine 100 including one of more of the compression chamber operations such as ram 115 control and mixing components, e.g., 120. In some applications, the computer may also be configured to automatically control the input and amount of the swarf 103 into the hopper 105. The at least one computer 130 may also control any one or more of the conveyors 205, 310, fans 305, dehumidifiers 320, and may control the ingress/egress of the briquettes into/out-of the container 350 and, in some implementations, may automatically control the passageways of the container for sealing the container 350 for drying operations. The at least one computer 130 may be programmed to control any operational parameter independently such as, e.g., motion speed of any system component, temperatures, processing times at any stage of the process, solution levels and concentrations, and the like. The at least one computer 130 may also be configured to detect faults at any stage of the operation to alert personnel. The at least one computer 130 may also record production statistics, for example, to count briquettes produced, processing throughput at any stage, and to provide or record lot information.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

What is claimed:

1. A method for processing titanium swarf, the method comprising steps of:

converting titanium swarf into titanium briquettes;

applying a fire retardant to the titanium briquettes; and drying the titanium briquettes after the applying step by:

freezing the titanium briquettes to a temperature of about 0° to about 25° F.;

raising or maintaining the temperature to about 100° F. in de-humidified conditions; and repeating the freezing and raising steps until the titanium briquettes have lost between 12 and 15% of original weight.

2. The method of claim 1, wherein the converting step comprises compressing titanium swarf into the titanium briquettes.

3. The method of claim 1, wherein the converting step includes mixing the titanium swarf with a liquid.

4. The method of claim 1, wherein the applying step comprises coating or immersing the titanium briquettes with a fire retardant material.

5. The method of claim 1, wherein the applying step comprises coating or immersing the titanium briquettes with sodium silicate.

6. The method of claim 1, wherein the step of drying the titanium briquettes occurs after the applying step.

7. The method of claim 1, wherein the drying step comprises drying the titanium briquettes using at least one of: a fan and a dehumidifier.

8. The method of claim 7, wherein the drying step comprises drying the titanium briquettes in a substantially sealed container.

* * * * *